US011440707B1

(12) United States Patent
Laible

(10) Patent No.: US 11,440,707 B1
(45) **Date of Patent: *Sep. 13, 2022**

(54) FOUR PORT CAP ADAPTER

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/183,594

(22) Filed: Feb. 24, 2021

Related U.S. Application Data

(63) Continuation of application No. 16/845,182, filed on Apr. 10, 2020, now Pat. No. 10,961,027, which is a continuation-in-part of application No. 16/682,625, filed on Nov. 13, 2019, now Pat. No. 10,618,705.

(51) Int. Cl.
*B65D 47/12* (2006.01)
*B65D 41/04* (2006.01)
*B05B 1/14* (2006.01)

(52) U.S. Cl.
CPC ..... *B65D 47/123* (2013.01); *B05B 1/14* (2013.01); *B65D 41/0492* (2013.01)

(58) Field of Classification Search
CPC B65D 47/32; B65D 47/2012; B65D 47/2018; B65D 47/2037; B65D 47/2043; B65D 47/205; B65D 47/24; B65D 47/241; B65D 47/242; B65D 47/26; B65D 47/261; B65D 47/263; B65D 47/266; B65D 47/283; B65D 47/28; B65D 47/123; B65D 47/122; B65D 47/12; B65D 47/126; B65D 47/128; B05B 15/30; B05B 1/14
See application file for complete search history.

(56) References Cited

U.S. PATENT DOCUMENTS 464,021 A * 12/1891 Hartin ..... F04D 13/16 137/209
722,523 A * 3/1903 Magidson ..... B67D 1/0456 215/4
1,073,963 A * 9/1913 Cottle ..... B05B 1/14 239/565
2,660,251 A * 11/1953 Birosh ..... A01M 13/00 119/604
3,677,248 A * 7/1972 McPhee ..... A61M 3/0241 604/500
4,445,539 A * 5/1984 Credle ..... B65D 83/0055 137/614.03
4,678,460 A * 7/1987 Rosner ..... A61M 5/142 392/470
5,087,250 A * 2/1992 Lichte ..... A61M 1/3627 604/319
5,165,578 A * 11/1992 Laible ..... B65D 51/1644 137/859

(Continued)

*Primary Examiner* — Patrick M. Buechner
(74) *Attorney, Agent, or Firm* — Luke C. Holst; McGrath North Mullin & Kratz, PC LLO

(57) ABSTRACT

A four port cap adapter for mounting on the upper end of a liquid chemical container with the throat of the container having a single draw container insert positioned therein. The adapter cap includes a lower housing, an upper housing, a cover support and a cover which are joined together. The lower and upper housings have a first fluid passageway extending therethrough. Four take-off supports and four take-offs are mounted on the upper wall of the cover. The four ports are in liquid communication with the first fluid passageway. The four ports are fluidly connected to dispensers or the like.

20 Claims, 7 Drawing Sheets

(56) References Cited

U.S. PATENT DOCUMENTS 5,445,186 A * 8/1995 Richter ..... B65D 47/2075 137/614.03
5,505,337 A * 4/1996 Littman ..... B65D 35/38 222/185.1
5,988,456 A * 11/1999 Laible ..... B67D 7/0277 222/464.1
6,142,345 A * 11/2000 Laible ..... B67D 7/0277 222/189.1
6,193,114 B1 * 2/2001 Hopkins ..... B65D 47/12 222/330
6,619,318 B2 * 9/2003 Dalhart ..... B01F 3/0865 137/565.22
6,669,062 B1 * 12/2003 Laible ..... B67D 7/0294 141/244
9,458,003 B1 10/2016 Laible
9,963,279 B2 * 5/2018 Huber ..... A61M 3/0241 604/500
10,576,702 B1 * 3/2020 Laible ..... A61M 5/142 392/470
10,618,705 B1 * 4/2020 Laible ..... A61B 17/3423 600/208
10,625,911 B1 * 4/2020 Laible ..... A61M 1/3627 604/319
D932,048 S * 9/2021 Laible ..... D24/220
2002/0017575 A1 * 2/2002 Andrews ..... B05B 1/14 239/337
2003/0150887 A1 * 8/2003 Laible ..... B67D 7/0294 222/529
2005/0150912 A1 * 7/2005 Casey ..... B67D 1/06 222/330
2010/0213220 A1 * 8/2010 Laible ..... B67D 7/0294 222/481.5
2011/0166425 A1 * 7/2011 Edelman ..... A61B 17/3423 600/208
2013/0334161 A1 * 12/2013 Meager ..... B65D 23/04 215/40
2014/0263314 A1 * 9/2014 Pruiett ..... A47L 11/4083 220/203.01
2016/0367734 A1 * 12/2016 Gavlak ..... A61B 17/1635
2017/0312767 A1 * 11/2017 Hassanlou ..... E03C 1/0408
2020/0230636 A1 * 7/2020 Burns ..... A61B 17/1635

* cited by examiner

FOUR PORT CAP ADAPTER

CROSS REFERENCE TO RELATED APPLICATION

This is a Continuation Application of application Ser. No. 16/845,182 filed Apr. 10, 2020, entitled FOUR PORT CAP ADAPTER, which is a Continuation-In-Part Application of application Ser. No. 16/682,625 filed Nov. 13, 2019, entitled DUAL DRAW CAP ADAPTER.

BACKGROUND OF THE INVENTION

Field of the Invention

This invention relates to a cap adapter which is used in conjunction with a container insert inserted into the throat of a chemical container. More particularly, this invention relates to a cap adapter which has first, second, third and fourth take-off ports which communicate with a single fluid passageway in the container insert to enable the chemical fluid in the container to be supplied to first, second, third and fourth dispensers or mixers respectively. Even more particularly, metering tips may be associated with the valves in the take-off ports or the dispensers to supply different chemical dilutions.

Description of the Related Art

Applicant's U.S. Pat. No. 9,458,003 disclosed a two port cap adapter for a liquid dispenser system. The cap adapter of the '003 patent has two take-off ports but the cap adapter of the '003 patent is not designed to dispense two different dilutions. Applicant's co-pending patent application has two take-off ports which are capable of supplying two different dilutions to two dispensers or the like. However, the invention of the co-pending application can only supply liquid chemical to two dispensers or the like.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A four port cap adapter is disclosed for mounting on the outlet opening of a liquid container. The four port cap adapter includes a cylindrical cap having a top wall with an internally threaded side wall extending downwardly therefrom with the top wall of the cap having a circular opening formed therein. The cylindrical cap is configured to be secured to the container at the outlet opening thereof.

The cap adapter includes a lower housing having upper and lower ends which is positioned in the cap at the upper end thereof. The lower housing includes a central liquid passageway which extends between the upper and lower ends thereof. The lower housing has a valve opening formed in the central liquid passageway thereof. A normally closed one-way valve is associated with the valve opening in the lower housing which permits the flow of liquid upwardly through the valve opening but which prevents the flow of liquid downwardly through the valve opening.

The four port adapter cap also includes an upper housing having an upper end portion with an upper end and a lower end portion with a lower end. The upper housing has a liquid passageway with upper and lower ends formed therein which extends between the lower end of the lower end portion and the upper end of the upper end portion. The lower end portion of the upper housing extends downwardly through the central opening of the top wall of the cap. The lower end portion of the upper housing is secured to the lower housing. The upper housing has an outwardly extending annular shoulder which is positioned above the top wall of the cap outwardly of the central opening in the top wall of the cap.

The four port cap adapter also includes a cover support which includes a vertically disposed hollow tubular lower end portion having upper and lower ends. The hollow tubular lower end portion of the cover support is secured to the upper end portion of the upper housing. The cover support also includes a horizontally disposed and ring-shaped wall, having inner and outer ends, which extends outwardly from the upper end of the hollow tubular lower end portion thereof. A vertically disposed cylindrical wall, having an upper end, a lower end, an inner side and an outer side, extends upwardly from the outer end of the ring-shaped wall of the cover support.

The four port cap adapter also includes a cover having a generally vertically disposed and cylindrical outer wall with an upper end and a lower end. A horizontally disposed upper wall, having inner and outer ends, extends inwardly from the upper end of the outer wall thereof. A ring-shaped and vertically disposed cylindrical wall, having upper and lower ends, extends downwardly from the upper wall inwardly of the outer wall of the cover support thereby defining a space therebetween.

First, second, third and fourth hollow take-off supports, having upper and lower ends, extend upwardly from the upper wall of the cover in a radially spaced-apart manner. Each of the take-off supports has internal threads. The upper wall of the cover has first, second, third and fourth openings formed therein which are positioned below the first, second, third and fourth take-off supports respectively.

First, second, third and fourth and normally closed one-way valves are associated with the first, second, third and fourth openings in the top wall. Each of the one-way valves permit the flow of liquid upwardly therethrough when open while preventing the flow of liquid downwardly therethrough when closed. First, second, third and fourth take-off ports are mounted in the first, second, third and fourth take-off supports respectively.

First, second, third and fourth tubes are secured to the first, second, third and fourth take-off ports respectively and extend to first, second, third and fourth liquid dispensers or mixing machines.

The cover embraces the lower housing, the upper housing, and the cover support with the cover being fixedly secured to the cover support. The dilutions of the liquid passing through the take-off ports may be changed by inserting metering devices therein or in the dispensers.

The principal object of the invention is to provide a four port cap adapter. A further object of the invention is to provide a four port cap adapter which may discharge four different dilutions.

A further object of the invention is to provide a four port cap adapter which is completely recyclable.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
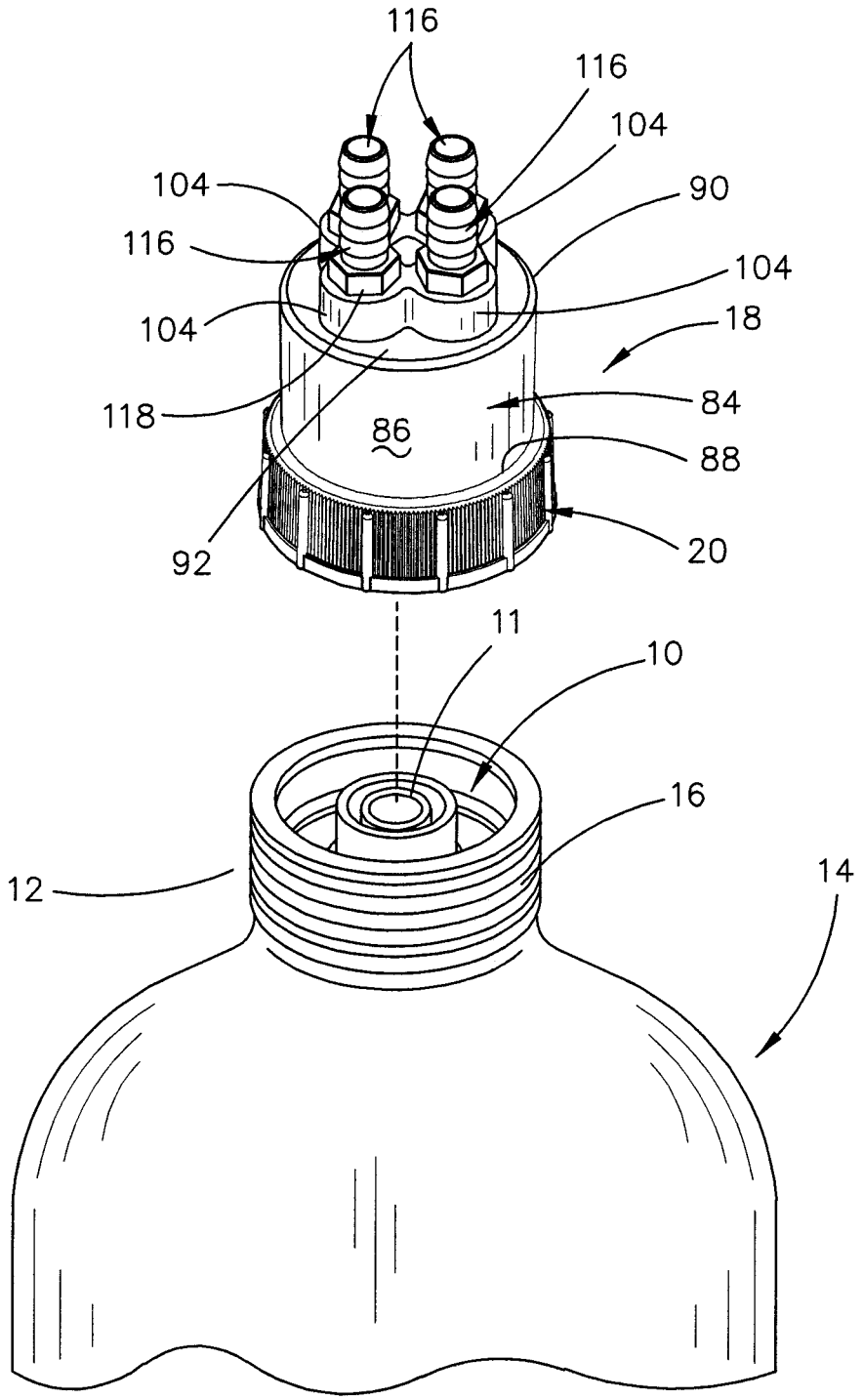
FIG. 1 is an exploded perspective view of the cap adapter of this invention which may be mounted on the container illustrated in FIG. 1.
Figure 2:
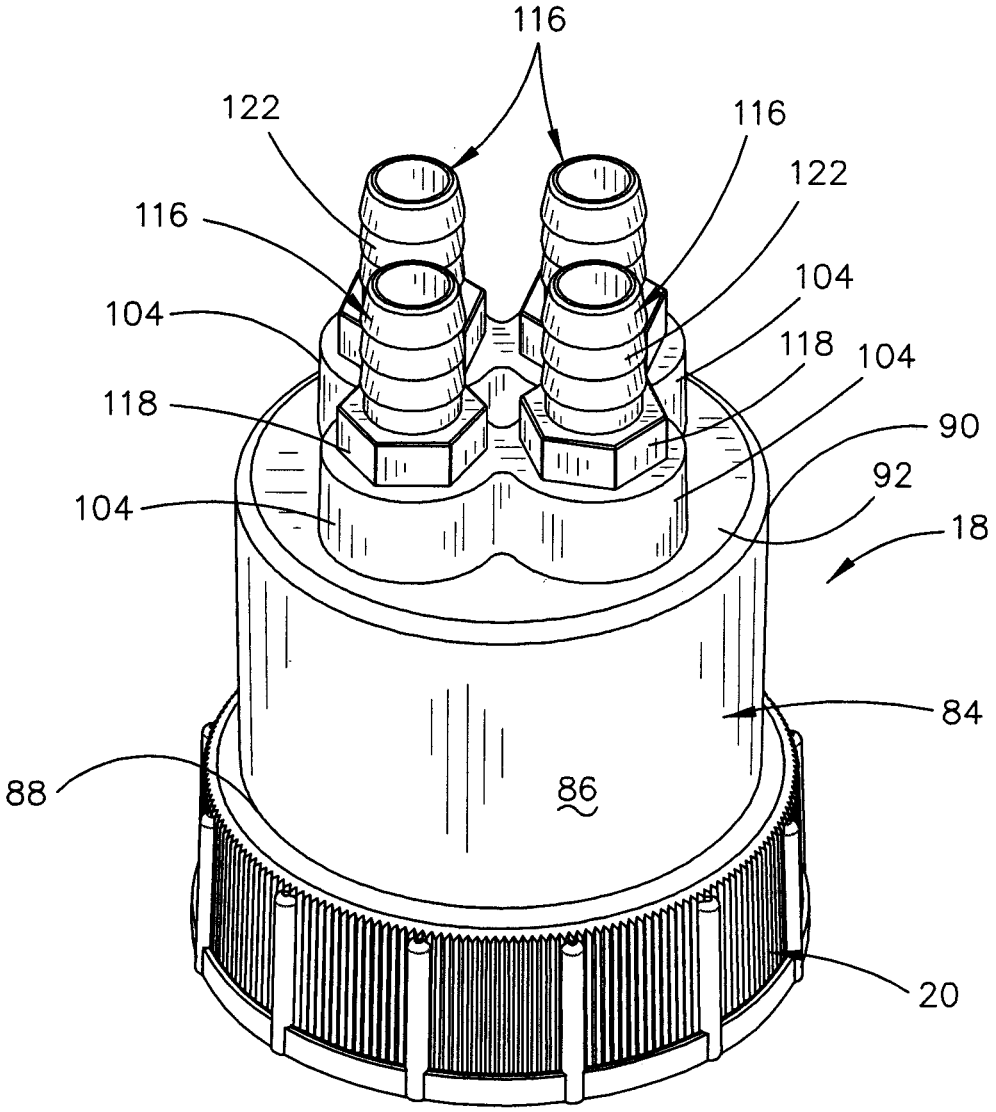
FIG. 2 is an upper perspective view of the cap adapter of this invention.
Figure 3:
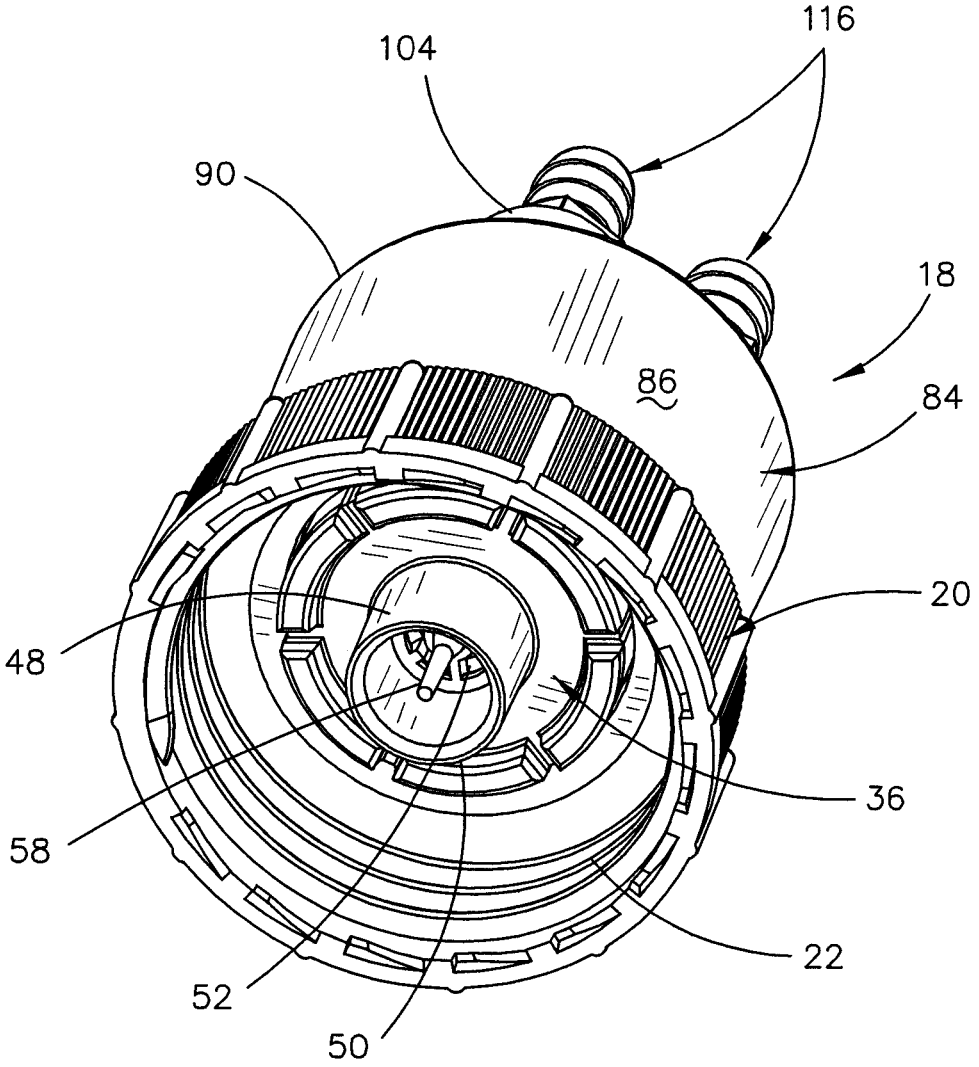
FIG. 3 is a lower perspective view of the cap adapter of this invention.
Figure 4:
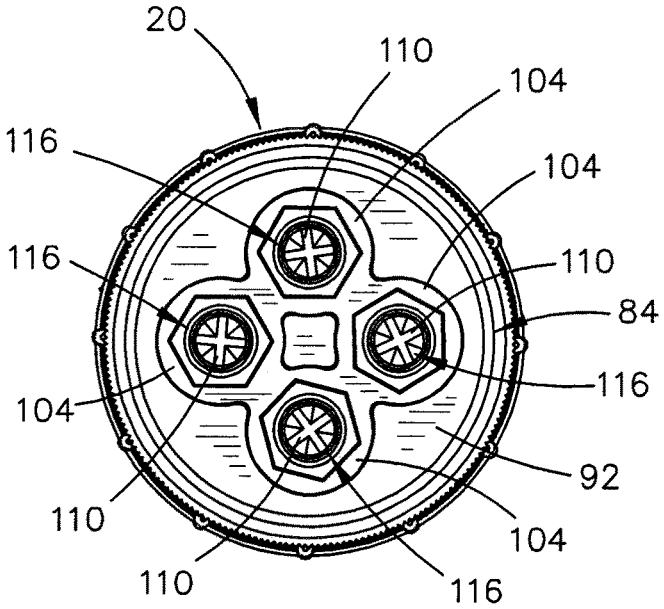
FIG. 4 is a top view of the cap adapter of this invention.
Figure 5:
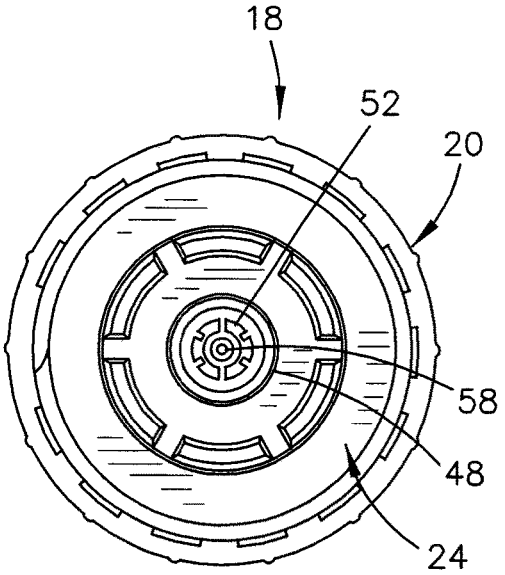
FIG. 5 is a bottom view of the cap adapter of this invention.
Figure 6:
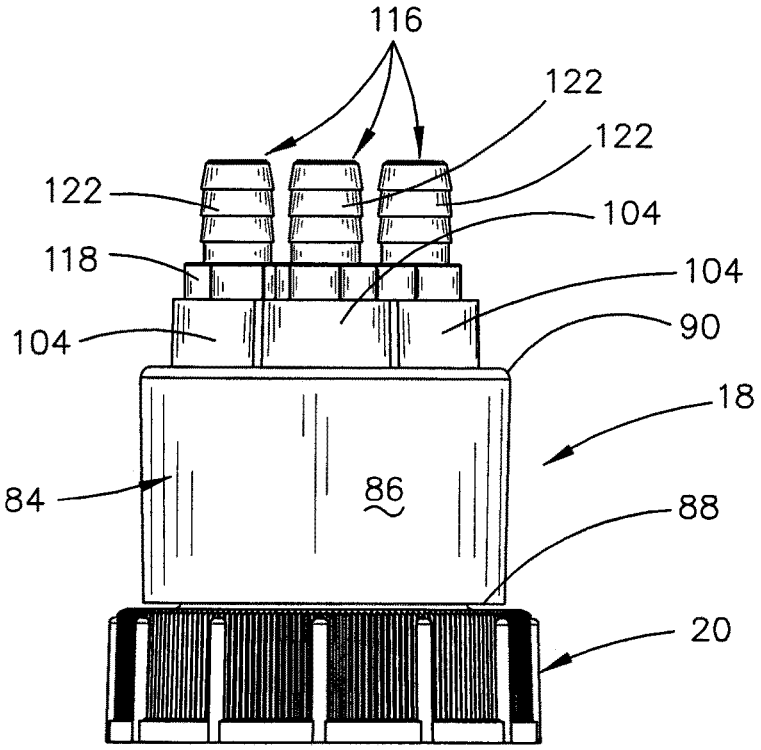
FIG. 6 is a side view of the cap adapter of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In the drawings, the numeral 10 refers to a container insert, having a liquid passageway 11, which is press-fitted into the throat or outlet opening 12 of a container 14 such as a bottle or the like. Preferably, throat 12 includes external threads 16. The container insert 10 is generally of the type described in U.S. Pat. No. 9,458,003 and the co-pending U.S. patent application Ser. No. 16/682,625 filed Nov. 13, 2019 entitled DUAL DRAW CAP ADAPTER, the disclosures of which are incorporated herein by reference thereto to complete this disclosure if necessary.

The numeral 18 refers to the four port cap adapter of this invention which is configured to be threadably mounted on throat 12 of the container 14 to supply liquid to four take-off mechanisms, such as dispensers, mixing machines, etc. Cap adapter 18 includes a cap or collar 20 which has internal threads 22 formed therein at its lower open end. Cap 20 includes a horizontally extending top wall 24 having an outer end 26 at an inner end 28. An upstanding cylindrical wall 30 extends upwardly from the inner end 28 of top wall 24. A ring-shaped shoulder 32 extends horizontally inwardly from the upper end of wall 30 to define an opening 34.

Figure 7:
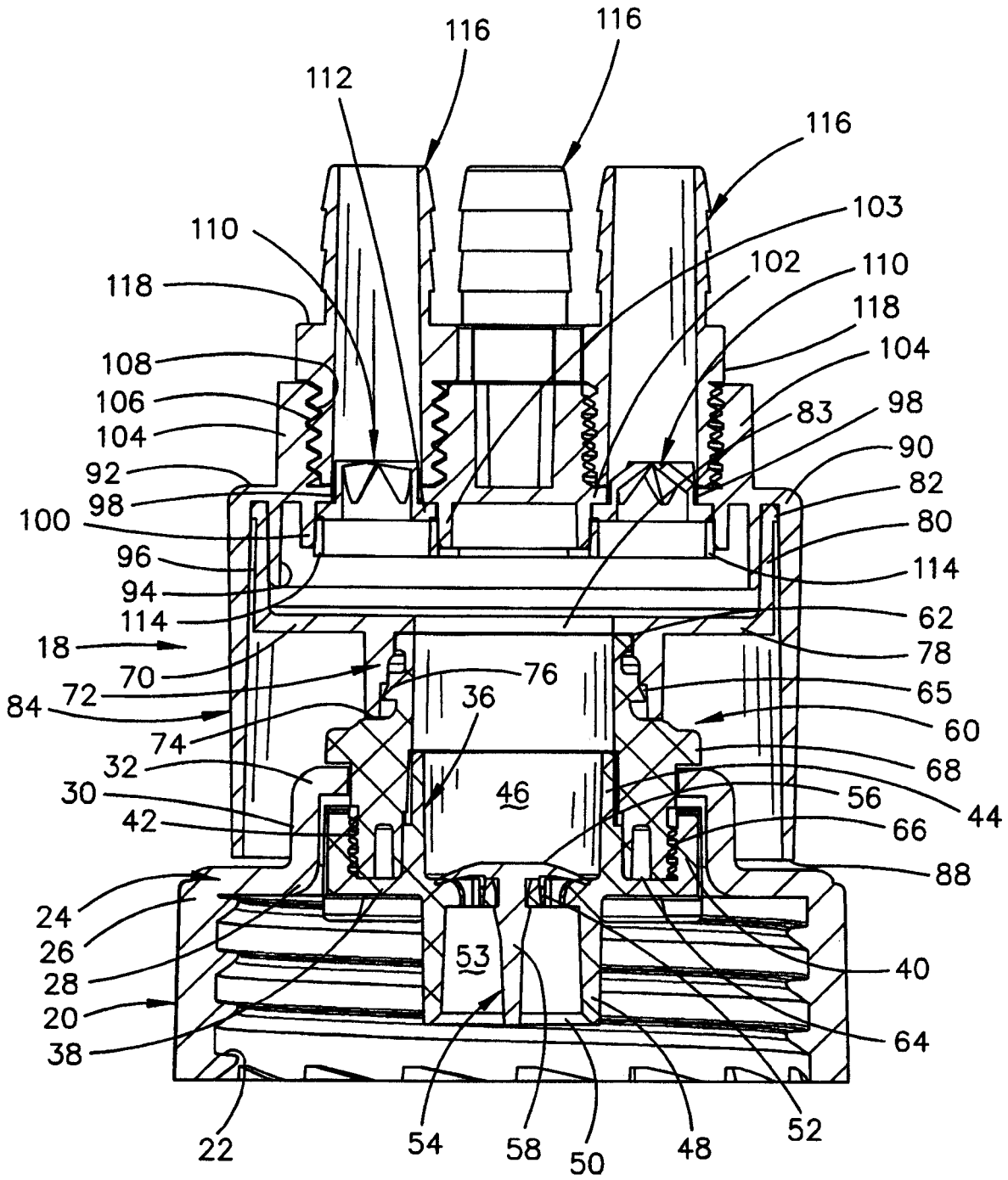
FIG. 7 is a sectional view of the cap adapter of this invention.

The numeral 36 refers to a lower housing. Lower housing 36 includes a horizontally disposed and ring-shaped wall 38. A cylindrical and vertically disposed wall 40 extends upwardly from the outer end of wall 38. The inner surface of wall 40 has threads 42 formed therein. Lower housing 36 also includes a vertically disposed and cylindrical tube 44 which extends upwardly from wall 38 at the inner end thereof. The interior of tube 44 defines a liquid passageway 46. Lower housing 36 also includes a vertically disposed and cylindrical tube 48 which extends downwardly from the inner end of wall 38. As seen in FIG. 7, tube 48 has an open lower end 50 and an opening 52 formed in the upper end thereof. Tube 48 defines a liquid passageway 53.

The numeral 54 refers to a flexible umbrella valve having an enlarged upper flap portion 56 and a shank portion 58 extending downwardly from upper flap portion 56. Upper flap position 56 extends over the opening 52 to normally close the opening 52. When flap portion 56 moves upwardly, the opening 52 is open to permit liquid to flow upwardly therethrough.

The numeral 60 refers to a hollow and generally cylindrical-shaped upper housing having an upper end 62 and a lower end 64. The upper end 62 of upper housing 60 has external threads 65 formed therein. The lower end 64 of upper housing 60 has exterior threads 66 formed therein. Upper housing 60 also has a ring-shaped shoulder 68 extending horizontally therefrom as seen in FIG. 7.

The lower end 64 of upper housing 60 extends downwardly through opening 34 of lower housing 36 as seen in the drawings. The threads 66 of upper housing 60 are threadably connected to the threads 42 of lower housing 36 to secure the upper housing 60 to the lower housing 36. When so secured, the shoulder 68 of upper housing 60 rests upon the shoulder 32 of cap 20.

The numeral 70 refers to a cover support. Cover support 70 includes a vertically disposed and ring-shaped or generally cylindrical lower end portion 72 having a lower end 74. Lower end portion 72 has threads 76 at the lower inside surface thereof which mesh with the threads 65. A horizontally disposed ring-shaped wall 78 extends horizontally outwardly from the upper end of lower end portion 72. A vertically disposed cylindrical wall 80 extends upwardly from the outer end of wall 78. The upper end of wall 80 has a protrusion 82 at its upper end which extends outwardly therefrom. Wall 78 has a central opening 83.

The numeral 84 refers to a cover which not only embraces a portion of the cap 18 but which also provides the four take-off supports of this invention as will be described hereinbelow. Cover 84 includes a tapered outer wall 86 having a lower end 88 and an upper end 90. The upper end of wall 86 has a horizontally disposed upper wall 92 which extends inwardly from the upper end 90 thereof. A vertically disposed and ring-shaped wall 94 extends downwardly from the lower side of wall 92 inwardly of outer wall 86. Wall 94 and outer wall 86 define a space 96 therebetween.

Wall 92 has four radially spaced-apart openings 98 formed therein. A cylindrical and hollow wall 100, which is formed integrally with upper wall 92, extends downwardly from wall 92 below each of the opening 98. Each of cylindrical walls 100 have a greater diameter than the associated opening 98 to create a ring-shaped protrusion 102 in wall 92. A vertically disposed cylindrical wall 103 extends downwardly from wall 92 as seen in FIG. 7.

Four take-off supports 104 are integrally formed with upper wall 92 and extend upwardly therefrom in a radially spaced-apart manner. The four take-off supports 104 are joined together as seen in the drawings. Each of the four take-off supports 104 define a central opening 106. Each of the four take-off supports 104 have internal threads 108.

Figure 8:
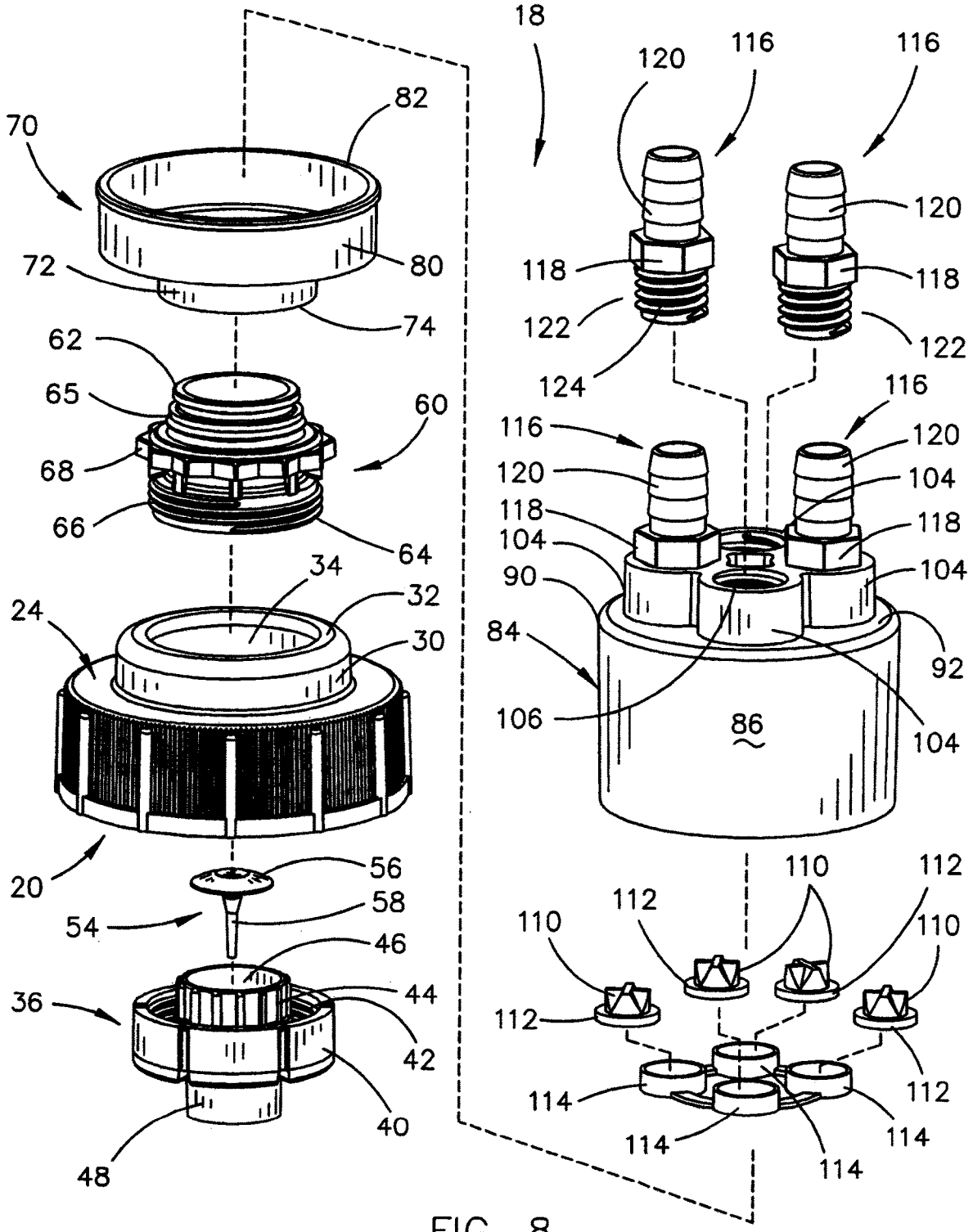
FIG. 8 is an exploded perspective view of the cap adapter of this invention.

A flexible and normally closed one-way valve 110 having a lower flange 112 is positioned in the central openings 106 of the four take-off supports 104. The flanges 112 of valves 110 engage the protrusion 102 to limit their upward movement. A circular or cylindrical retainer ring 114 is inserted upwardly between walls 100 and 103 below each of the valves 110 to frictionally hold the valve 110 in position. As seen in FIG. 8, the rings 114 are jointed together for ease of installation.

The numerals 116 refer to take-off ports or take-offs which are mounted on take-off supports 104. Each of the ports 116 includes a wrench flange 118 to threadably install the port 116 into the take-off support 104. An exteriorly barbed and hollow tubular portion 120 extends upwardly from flange 118. A hollow tubular portion 122 extends downwardly from each of the flanges 118 and has external threads 124 formed therein. As seen, the open lower ends of the ports 116 fluidly communicate with the openings 98 in cover 84.

Figure 9:
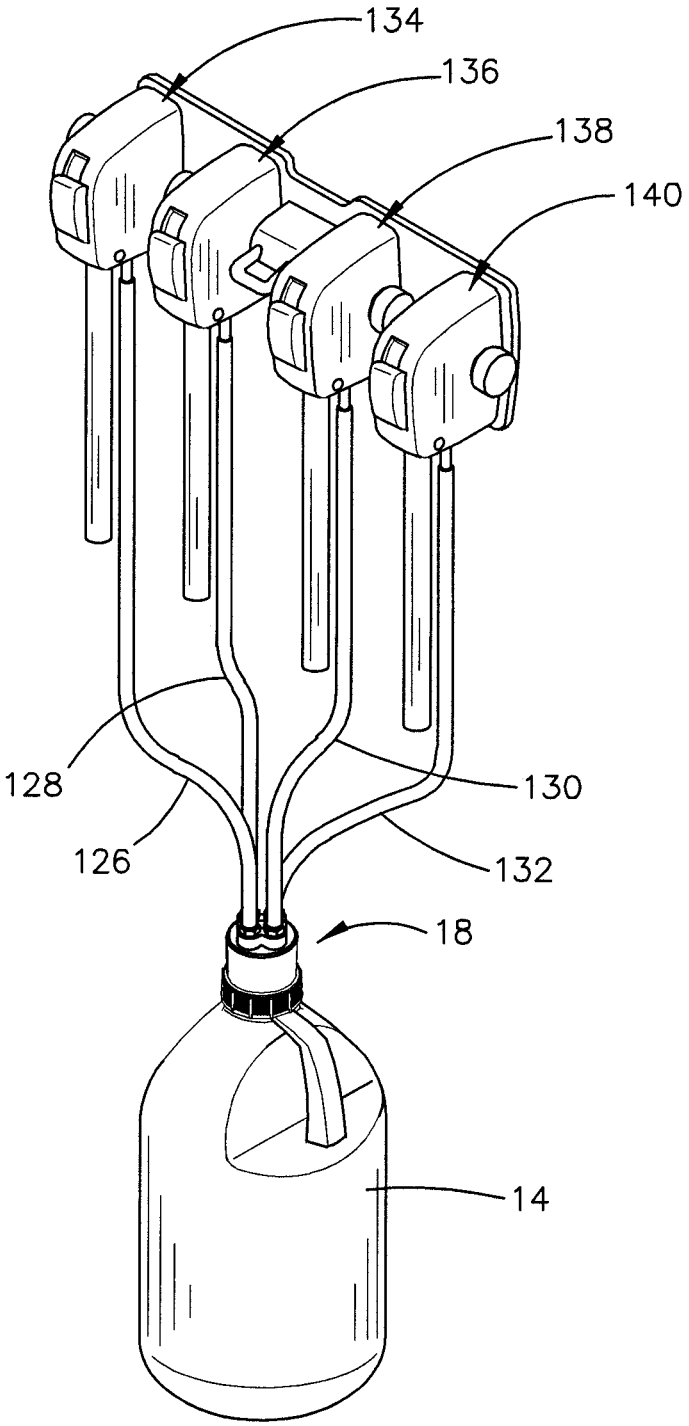
FIG. 9 is a perspective view which illustrates the cap adapter of this invention mounted on a chemical container with the cap adapter being fluidly connected to four dispensers.

FIG. 9 illustrates four discharge tubes 126, 128, 130 and 132 attached to the four ports 116 and which extend to dispensers 134, 136, 138 and 140 respectively. Although dispensers are shown, other devices such as mixers may be used. The chemical dilution of the liquid being discharged from each of the ports 116 may be changed by positioning conventional metering devices in each of the ports 116 or in the dispensers 134, 136, 138 and 140. Thus, four different dilutions may be produced.

Preferably, the entire cap is produced from a suitable plastic material so that the entire cap adapter is recyclable.

The cap adapter 18 functions as follows. The container insert 10 is designed to supply liquid from container 14 by way of a single liquid passageway which is normally closed. Cap adapter 18 is secured to the outlet opening 12 by cap 20 being threadably mounted thereon. When so secured, the lower end 50 of tube 48 engages the container insert 10 to permit liquid to be drawn upwardly through the liquid passageway 11 when liquid is being discharged from cap adapter 18. When one or more of the dispensers 134, 136, 138 and 140 are activated, the dispenser will create a suction in the associated tube to create a suction in the liquid passageways within cap adapter 18. When suction is applied to the cap adapter 18, the one-way umbrella valve 54 will open to permit liquid from the container insert 10 to be drawn upwardly therethrough. The liquid will be drawn upwardly through the liquid passageways 46 and 53 in lower housing 36, thence upwardly through upper housing 60, thence through the cover support 70, thence through the associated slit valve 110, then upwardly through the associated take-off support 104, thence upwardly through the associated take-off or port 116 and thence into the associated tube to the associated dispenser. If the cap adapter 18 is removed from the container 14, the umbrella valve 54 will be closed to prevent liquid in the cap adapter 18 and the liquid in tubes 126, 128, 130 and 132 from draining therefrom.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A cap adapter configured to be mounted on an outlet opening of a container, the cap adapter comprising:

a cap;

a lower housing having a passageway;

a valve positioned in the passageway of the lower housing;

an upper housing having a passageway;

said upper housing being coupled to the lower housing;

a cover support;

said cover support coupled to the upper housing;

a cover;

said cover being removably secured to the cover support; and said cover comprising four take-off supports and four take-off ports;

wherein said take-off ports are in liquid communication with said outlet opening of said container;

wherein said take-off ports are configured to be placed in fluid communication with dispensers, mixers or combinations thereof.

2. The cap adapter of claim 1, further comprising:

said cap being hollow having an upper end and a lower end;

said cap having a horizontally disposed upper wall at said upper end thereof;

said upper wall of the cap having a central opening; and said lower end of the cap being coupled to the outlet opening of the container.

3. The cap adapter of claim 1, further comprising:

said lower housing having an upper end and a lower end;

said lower housing positioned in the cap at an upper end thereof;

said passageway of the lower housing extending between the upper end and the lower end of the lower housing;

said lower housing having a valve opening formed in the passageway; and said valve being associated with the valve opening formed in the passageway of the lower housing.

4. The cap adapter of claim 1, further comprising:

said upper housing having an upper end portion with an upper end and a lower end portion with a lower end;

said passageway of the upper housing extending between the lower end of the lower end portion and the upper end of the upper end portion of the upper housing;

said lower end portion of said upper housing extending downwardly through a central opening of an upper wall of the cap;

said lower end portion of the upper housing being coupled to the lower housing; and an outwardly extending annular shoulder positioned above the upper wall of the cap and outwardly of the central opening of the upper wall of the cap.

5. The cap adapter of claim 1, further comprising:

said cover support having a vertically disposed hollow tubular lower end portion having an upper end and a lower end;

said hollow tubular lower end portion being threadably coupled to an upper end portion of the upper housing;

said cover support having a horizontally disposed ring-shaped wall, having an inner end and an outer end, which extends outwardly from the upper end of the hollow tubular lower end portion thereof; and said cover support having a vertically disposed cylindrical wall, an upper end, a lower end, an inner side and an outer side, extending upwardly from the outer end of the ring-shaped wall.

6. The combination of claim 1, wherein said cover further comprises:

a generally vertically disposed and cylindrical outer wall having an upper end and a lower end;

a horizontally disposed upper wall, having an inner end and an outer end, extending inwardly from the upper end of the outer wall thereof;

said four take-off supports extending upwardly from the upper wall in a radially spaced-apart manner;

said four take-off supports being internally threaded;

said upper wall having a first opening, a second opening, a third opening, and a fourth opening formed therein which are positioned below the four take-off supports respectively; and a first valve, a second valve, a third valve, and a fourth valve associated with the first opening, second opening, third opening, and fourth opening respectively in the upper wall;

said first valve, second valve, third valve, and fourth valve are one-way valves that are configured to permit the flow of liquid upwardly therethrough when open while preventing the flow of liquid downwardly therethrough when closed; and said four take-off ports positioned in the four take-off supports respectively.

7. The combination of claim 1, wherein said cover support includes:

a vertically disposed hollow tubular lower end portion having upper and lower ends;

said hollow tubular lower end portion configured to be secured to an upper end portion of said upper housing;

a horizontally disposed ring-shaped wall, having inner and outer ends, which extends outwardly from said upper end of said hollow tubular lower end portion thereof; and a vertically disposed cylindrical wall, an upper end, a lower end, an inner side and an outer side, extending from said outer end of said ring-shaped wall of said cover support.

8. The combination of claim 1, wherein a ring-shaped and vertically disposed cylindrical wall, having an upper end and a lower end, extends downwardly from an upper wall of the cover thereby defining a space therebetween and wherein an upper end of a cylindrical wall of the cover support is frictionally received in said space to removably secure the cover to the cover support.

9. The combination of claim 8, wherein said upper end of the cylindrical wall of the cover support has a ring-shaped protrusion extending outwardly therefrom which is configured to frictionally engage the cylindrical wall of the cover when the upper end of the cylindrical wall of the cover support is received in said space.

10. In combination:

a liquid container having an outlet opening with external threads;

a container insert mounted in said outlet opening of said liquid container;

said container insert having a liquid discharge opening;

a cap adapter configured to be mounted on said outlet opening of said liquid container;

said cap adapter comprising:

a) a cap;

b) said cap being coupled to the outlet opening of the liquid container;

c) a lower housing;

d) said lower housing including a first passageway which extends therethrough;

e) said lower housing further including a valve positioned in the first passageway;

f) an upper housing;

g) said upper housing including a second passageway which extends therethrough;

h) said upper housing having a shoulder extending horizontally therefrom;

i) said upper housing being coupled to the lower housing wherein the first and second passageways are configured to permit liquid to flow therethrough;

j) a cover support;

k) said cover support coupled to the upper housing;

l) a cover;

m) said cover removably secured to the cover support; and n) said cover comprising:

i. four take-off supports; and ii. four take-off ports;

iii. wherein said four take-off ports are coupled to the four take-off supports;

whereby said take-off ports of the cap adapter are in liquid communication with said liquid discharge opening of said container insert;

whereby said four take-off ports of the cap adapter are configured to be placed in fluid communication with four dispensers, four mixers or combinations thereof.

11. The combination of claim 10, wherein said four take-off ports of the cap adapter each comprise a wrench flange configured to threadably couple the take-off port to the take-off support.

12. The combination of claim 10, wherein said cover support is frictionally received by the cover to removably secure the cover to the cover support.

13. The combination of claim 10, further comprising:

said cap being hollow having an upper end and a lower end;

said cap having a horizontally disposed upper wall at said upper end thereof;

said upper wall of the cap having a central opening; and said lower end of the cap being coupled to the outlet opening of the liquid container.

14. The combination of claim 10, further comprising:

said lower housing having an upper end and a lower end;

said lower housing positioned in the cap at an upper end thereof;

said first passageway extending between the upper end and the lower end of the lower housing;

said lower housing having a valve opening formed in the first passageway; and said valve being associated with the valve opening formed in the first passageway of the lower housing.

15. The combination of claim 10, further comprising:

said upper housing having an upper end portion with an upper end and a lower end portion with a lower end;

said second passageway extending between the lower end of the lower end portion and the upper end of the upper end portion of the upper housing;

said lower end portion of said upper housing extending downwardly through a central opening of an upper wall of the cap;

said lower end portion of the upper housing being coupled to the lower housing; and said shoulder of the upper housing positioned above the upper wall of the cap and outwardly of the central opening of the upper wall of the cap.

16. The combination of claim 10, further comprising:

said cover support having a vertically disposed hollow tubular lower end portion having an upper end and a lower end;

said hollow tubular lower end portion being threadably coupled to an upper end portion of the upper housing;

said cover support having a horizontally disposed ring-shaped wall, having an inner end and an outer end, which extends outwardly from the upper end of the hollow tubular lower end portion thereof; and said cover support having a vertically disposed cylindrical wall, an upper end, a lower end, an inner side and an outer side, extending upwardly from the outer end of the ring-shaped wall.

17. The combination of claim 10, wherein said cover further comprises:

a generally vertically disposed and cylindrical outer wall having an upper end and a lower end;

a horizontally disposed upper wall, having an inner end and an outer end, extending inwardly from the upper end of the outer wall thereof;

said four take-off supports extending upwardly from the upper wall in a radially spaced-apart manner;

said four take-off supports being internally threaded;

said upper wall having a first opening, a second opening, a third opening, and a fourth opening formed therein which are positioned below the four take-off supports respectively;

a first valve, a second valve, a third valve, and a fourth valve associated with the first opening, second opening, third opening, and fourth opening respectively in the upper wall;

said first valve, second valve, third valve, and fourth valve are one-way valves that are configured to permit the flow of liquid upwardly therethrough when open while preventing the flow of liquid downwardly therethrough when closed; and said four take-off ports positioned in the four take-off supports respectively.

18. The combination of claim 10, wherein said cover support includes:

a vertically disposed hollow tubular lower end portion having upper and lower ends;

said hollow tubular lower end portion configured to be secured to an upper end portion of said upper housing;

a horizontally disposed ring-shaped wall, having inner and outer ends, which extends outwardly from said upper end of said hollow tubular lower end portion thereof; and a vertically disposed cylindrical wall, an upper end, a lower end, an inner side and an outer side, extending from said outer end of said ring-shaped wall of said cover support.

19. The combination of claim 10, wherein a ring-shaped and vertically disposed cylindrical wall, having an upper end and a lower end, extends downwardly from an upper wall of the cover thereby defining a space therebetween and wherein an upper end of a cylindrical wall of the cover support is frictionally received in said space to removably secure the cover to the cover support.

20. The combination of claim 19, wherein said upper end of the cylindrical wall of the cover support has a ring-shaped protrusion extending outwardly therefrom which is configured to frictionally engage the cylindrical wall of the cover when the upper end of the cylindrical wall of the cover support is received in said space.

* * * * *